US005882349A

United States Patent [19]

Wilkerson et al.

[11] Patent Number: 5,882,349

[45] Date of Patent: Mar. 16, 1999

[54] PATIENT MOISTURE CONTROL SUPPORT SURFACE COVERLET

[75] Inventors: Jack Wilkerson, Pleasant Valley; Oliver H. Bodine, Jr., Garrison, both of N.Y.

[73] Assignee: Geomarine Systems, Inc., Sanford, Fla.

[21] Appl. No.: 581,396

[22] Filed: Dec. 26, 1995

[51] Int. Cl.[6] ..... A61M 35/00

[52] U.S. Cl. ..... 604/289; 5/423; 604/290

[58] Field of Search ..... 604/289–290, 604/291, 304, 312, 313, 315; 5/423, 726, 939, 453, 455; 607/104, 114

[56] References Cited

U.S. PATENT DOCUMENTS

| | | | |
|---|---|---|---|
| 2,691,173 | 10/1954 | Smith | 604/291 |
| 3,230,556 | 1/1966 | Shippee | 5/423 |
| 3,444,922 | 5/1969 | Dingman | 5/423 |
| 3,610,238 | 10/1971 | Rich, Jr. | 604/312 |
| 4,381,611 | 5/1983 | Wishman | 604/312 |
| 4,939,804 | 7/1990 | Grant | 5/423 |
| 5,007,123 | 4/1991 | Salyards | 5/939 |
| 5,168,589 | 12/1992 | Stroh et al. | 5/455 |
| 5,249,318 | 10/1993 | Loadsman | 5/453 |
| 5,265,599 | 11/1993 | Stephenson et al. | 5/423 |
| 5,405,370 | 4/1995 | Irani | 607/104 |
| 5,411,494 | 5/1995 | Rodriguez | 604/291 |
| 5,458,516 | 10/1995 | Uglene et al. | 2/2.16 |

*Primary Examiner*—John G. Weiss
*Assistant Examiner*—David J. Cho
*Attorney, Agent, or Firm*—John H. Crozier

[57] ABSTRACT

In one preferred embodiment, a patient moisture control support surface coverlet to draw moisture from a patient reposed thereon, the coverlet including: an outer layer of an air-tight, water-vapor-permeable material; an inner layer of an air- and vapor-impermeable material underlying the outer layer and sealed to the lower surface of the outer layer to define therebetween a volume to underlie a substantial portion of the patient; apparatus to introduce a flow of air to at least a portion of the volume; and apparatus to permit the flow of air to exit at least a portion of the volume.

18 Claims, 4 Drawing Sheets

PATIENT MOISTURE CONTROL SUPPORT SURFACE COVERLET

BACKGROUND OF THE INVENTION

1. Field of the Invention

The present invention relates to moisture control therapy generally and, more particularly, but not by way of limitation, to novel patient moisture control support surface coverlet and method that are economical and easily used on a variety of supporting structures.

2. Background Art

A major problem in health care facilities is with bed-bound patients who cannot turn or roll over. Failure of a patient to turn or roll over relatively frequently causes restriction of blood flow in the area of bony protruberances on a patient's body which, in turn, causes ulcerated bed, or pressure sores. Such sores are extremely long-healing and, with a chronically or terminally ill patient, frequently occur. According to hospital industry sources several years ago, it was estimated that to cure a single bed sore cost society an average of $40,000 and many patients died from bed sores.

Recently, "low-loss air beds" or mattress structures have been developed for the treatment and prevention of bed sores. In such a bed, typically, the standard mattress is replaced with a plurality of air bags disposed perpendicularly to the axis of the bed from its head to its foot. A plurality of small streams of air flow from the upper surfaces of the air bags which are covered by a polyurethane coated, vapor-permeable sheet which has a breathable, loose weave, uncoated, Nylon backing layer. The streams of air flow from the air bags, through the backing layer, and along the under surface of the vapor-permeable sheet to dry any moisture vapor which permeates through the sheet and, therefore, help remove a cause of bed sores and reduce the frequency of bedding changes. An air bed system of the type generally described above is disclosed in U.S. Pat. No. 5,216,768, issued Jun. 8, 1993, and titled BED SYSTEM, the disclosure of which is incorporated by reference hereinto.

While low-loss air beds and mattress structures have greatly improved the care given immobile patients, such devices of conventional construction are relatively expensive because of the cost of construction of the air bags and because the devices require the use of air blowers that must produce a relatively high pressure air output to inflate the air bags.

Accordingly, it is a principal object of the present invention to provide patient moisture control device and method that are economical.

It is a further object of the invention to provide such device that can be used with a variety of supporting structures.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in one preferred embodiment, a patient moisture control support surface coverlet to draw moisture from a patient reposed thereon, said coverlet comprising: an outer layer of an air-tight, water-vapor-permeable material; an inner layer of an air- and vapor-impermeable material underlying said outer layer and sealed to the lower surface of said outer layer to define therebetween a volume to underlie a substantial portion of said patient; means to introduce a flow of air to at least a portion of said volume; and means to permit said flow of air to exit said at least a portion of said volume.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
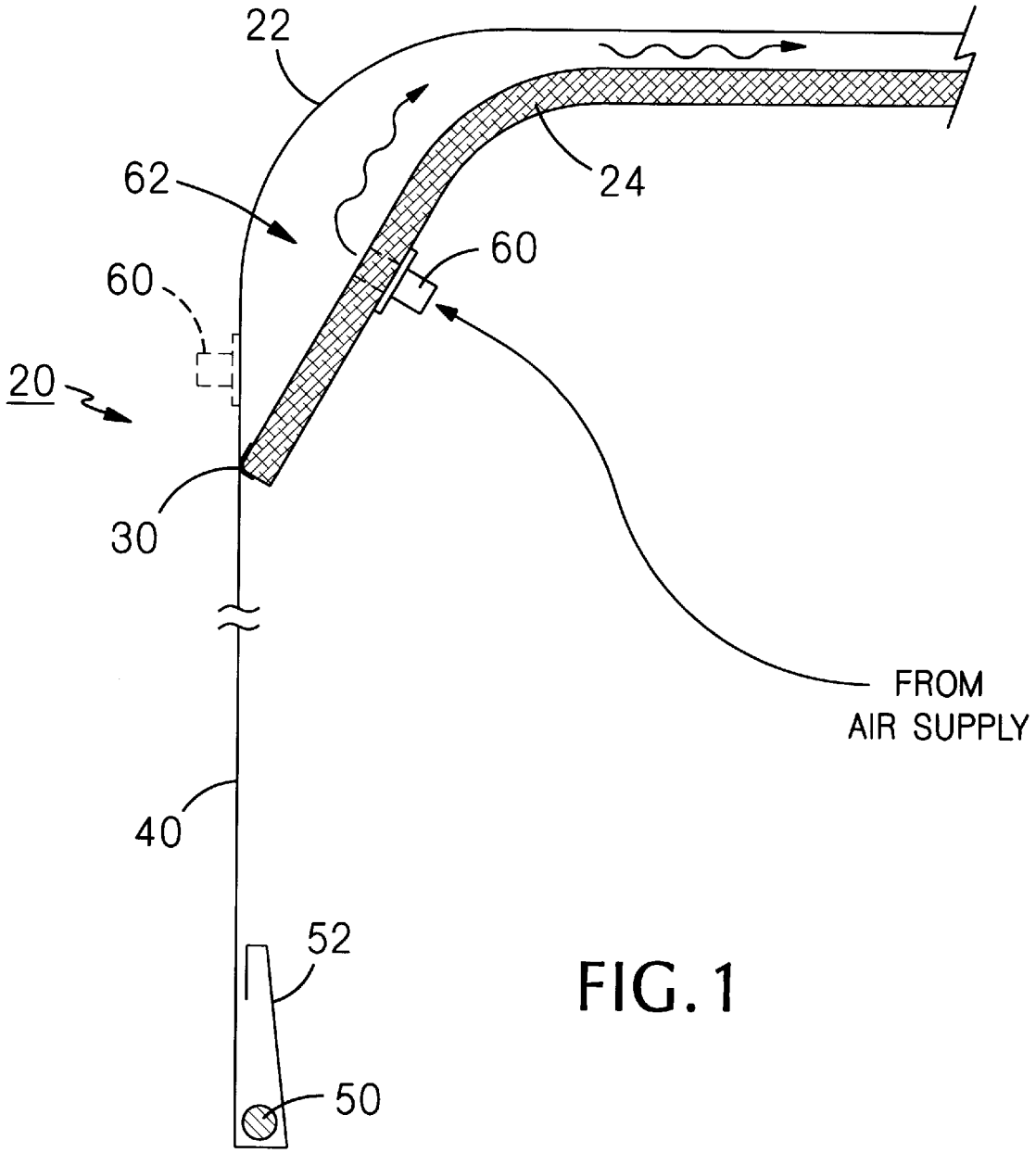
FIG. 1 is an end elevational view, partially in cross-section and partially schematic, of one embodiment of a patient moisture control support surface coverlet constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates one embodiment of a patient moisture control support surface coverlet, generally indicated by the reference numeral 20, and constructed according to the present invention. Coverlet 20 includes an outer layer 22 of an air-tight, water-vapor-permeable material such as is used with conventional low-air-loss therapy beds; for example, 70-denier taffeta with a polyurethane coating. An inner layer 24 of an air- and vapor-impermeable material, such as 8–24-ounce polyester batting, is RF welded to outer layer 22 around the edges, as at 30, of the inner layer. Outer layer 22 extends downwardly to form a side panel 40, the side panel being long enough to cover the sides (not shown) of whatever structure on which coverlet 20 is to be placed. A non-elastic cord 50 is disposed in a hem 52 formed around the lower end of side panel 40 by stitching or other suitable means. A nipple 60 (solid lines) is mounted in inner layer 24 near the edge thereof to introduce pressurized air from an air supply (not shown) into a volume 62 defined between the inner layer and outer layer 22. Alternatively, nipple 60 (broken lines) may be mounted in outer layer 22 near the edge thereof.

Figure 2:
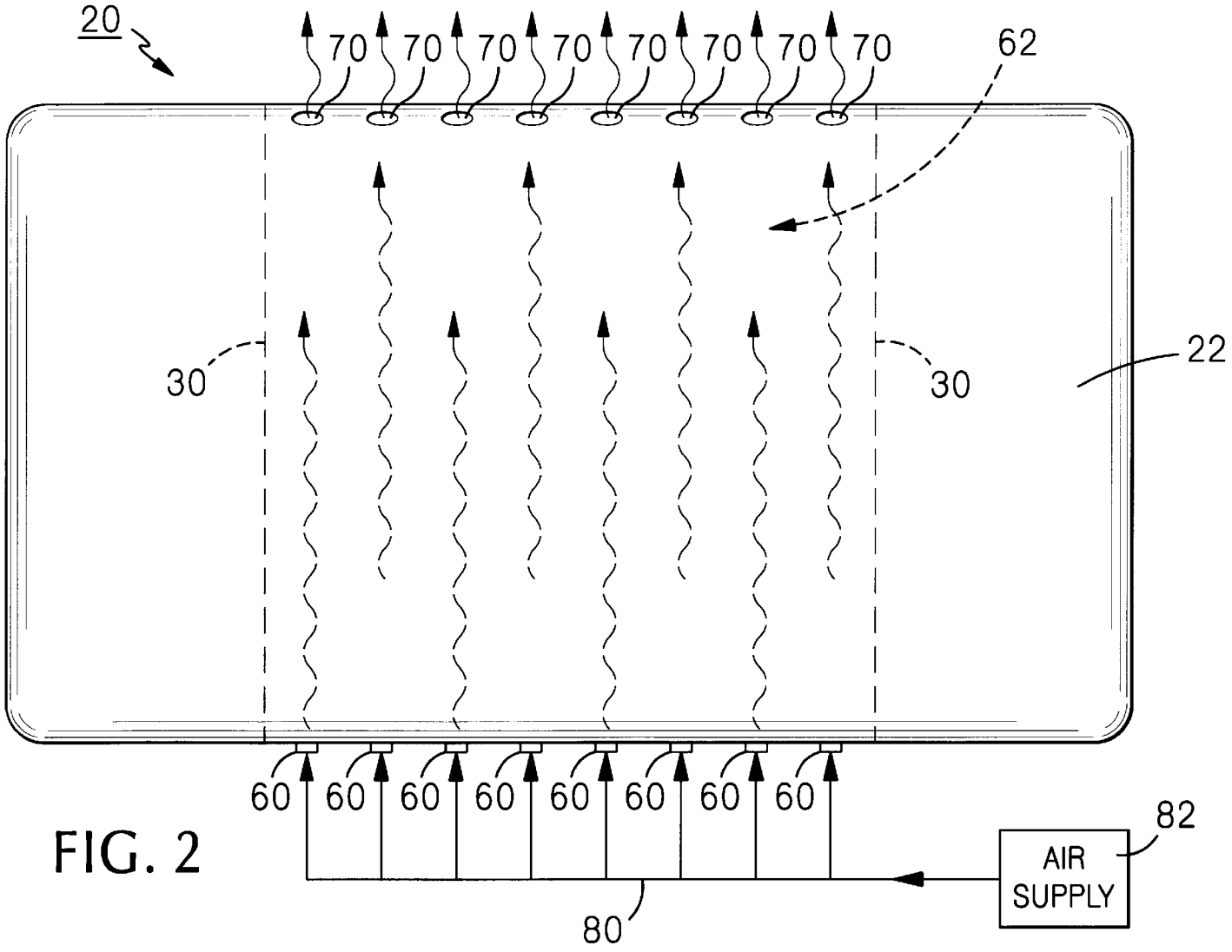
FIG. 2 is a top plan view, partially schematic, of the patient moisture control support surface coverlet of FIG. 1.

With reference also to FIG. 2, it can be seen that inner layer 24 is also RF welded, as at 30, to outer layer 22 at lengthwise margins thereof to further define volume 62, the margins being placed such that volume 62 would underlie approximately the area between the shoulders and knees of a patient (not shown).

A plurality of nozzles 60 is disposed along one edge of coverlet 20 to introduce pressurized air into volume 62 through which the air flows to, and exits from, a plurality of grommets 70 disposed in the opposite edge of the coverlet. The air is conveyed to nozzles 60 through a suitable conduit system 80 from an air supply 82. As the air flows through volume 62 along the lower surface of outer layer 22 (FIG. 1), it picks up water vapor permeating through the outer layer and discharges it through grommets 70 into the surrounding air.

A particular advantage of coverlet 20 is that air supply 82 need only furnish air at a relatively low pressure; for example, 5 CFM at 2–4 inches water pressure, as compared to 11 inches water pressure for a conventional low-air-loss therapy mattress. This results in substantial cost savings. The present invention has the capability of removing a minimum of 400 ml. skin moisture per 24 hours. This represents a safety factor of two over the 200 ml. skin moisture produced by a typical healthy person, to accommodate diabetic patients.

Figure 3:
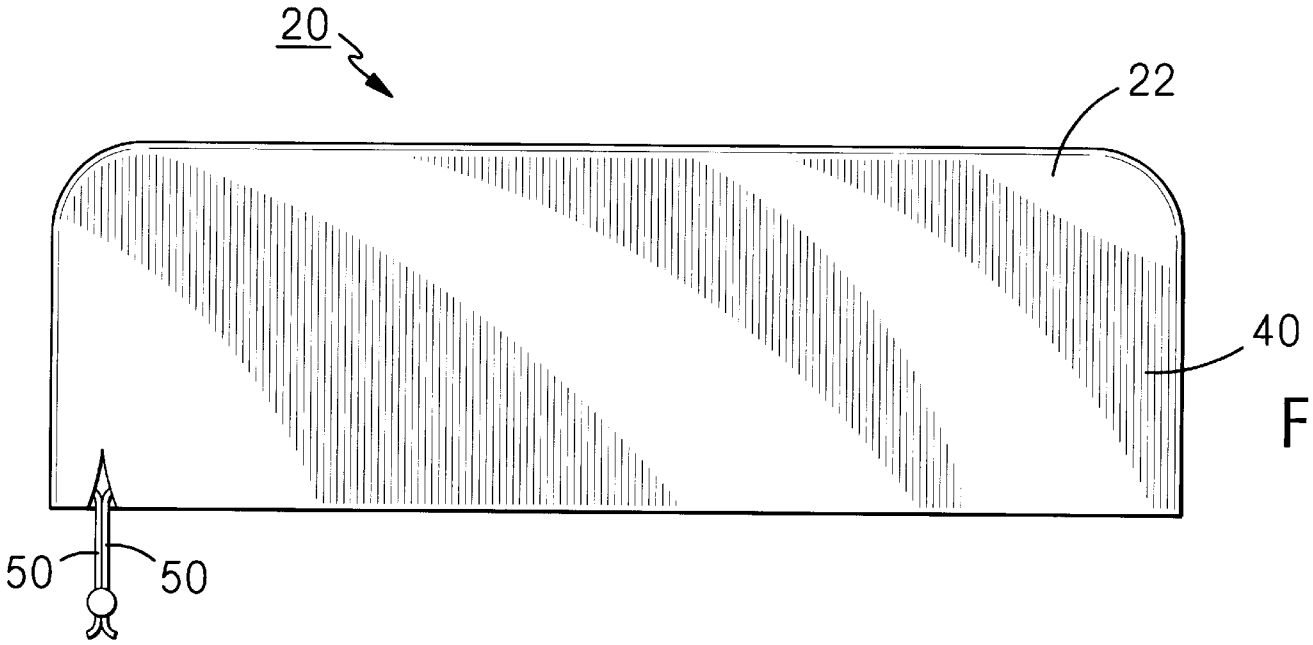
FIG. 3 is a side elevational view of the patient moisture control support surface coverlet of FIG. 1 covering a supporting structure.

A further advantage of coverlet 20 is that it can be placed on nearly any sort of supporting structure; for example, a regular mattress, a static air mattress, a water bed, or a foam mattress. As seen on FIG. 3, coverlet 20 is simply placed over the supporting structure (not shown) and cords 50 drawn up and secured by any suitable means to secure the coverlet in place. Then, conduit system 80 (FIG. 2) is connected to nozzles 60 and coverlet 20 is ready for use.

Figure 4:
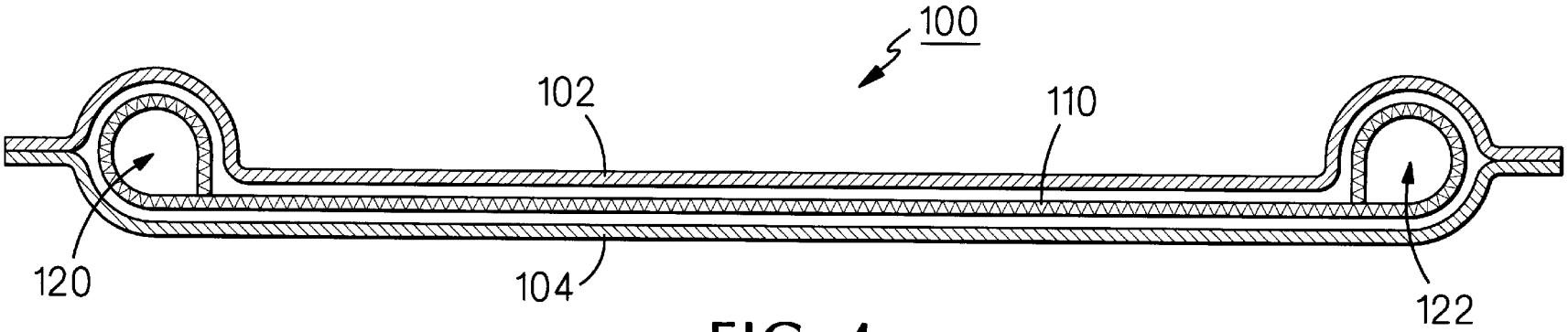
FIG. 4 is a end elevational, cross-sectional view of another embodiment of a patient moisture control support surface coverlet constructed according to the present invention.

FIG. 4 illustrates another embodiment of a patient moisture control support surface coverlet, generally indicated by the reference numeral 100, and constructed according to the present invention. Coverlet 100 includes an outer layer 102 of an air-tight, water-vapor-permeable material, similar to element 22 of coverlet 20 (FIG. 1), and an inner layer 104 of an air-and vapor-impermeable material, similar to element 24 of coverlet 20. Layers 102 and 104 are releasably sealed to each other at the edges thereof by hook-and-loop fabric or other suitable, easily releasable means.

Sandwiched between facing surfaces of outer and inner layers 102 and 104 is a layer 110 of moisture-wicking fabric, similar to COMPLY incontinent fabric furnished by a partnership of Standard Textile and Guilford Mills. Such a fabric is multi-layered with an upper layer of a highly-wicking, non-absorbent material, such as polyester, a middle layer of cotton-polyester material, and a lower layer of cotton material. The side edges of fabric layer 110 are rolled and sealed to form parallel, generally circular channels 120 and 122 extending along the side edges of the fabric.

Figure 5:
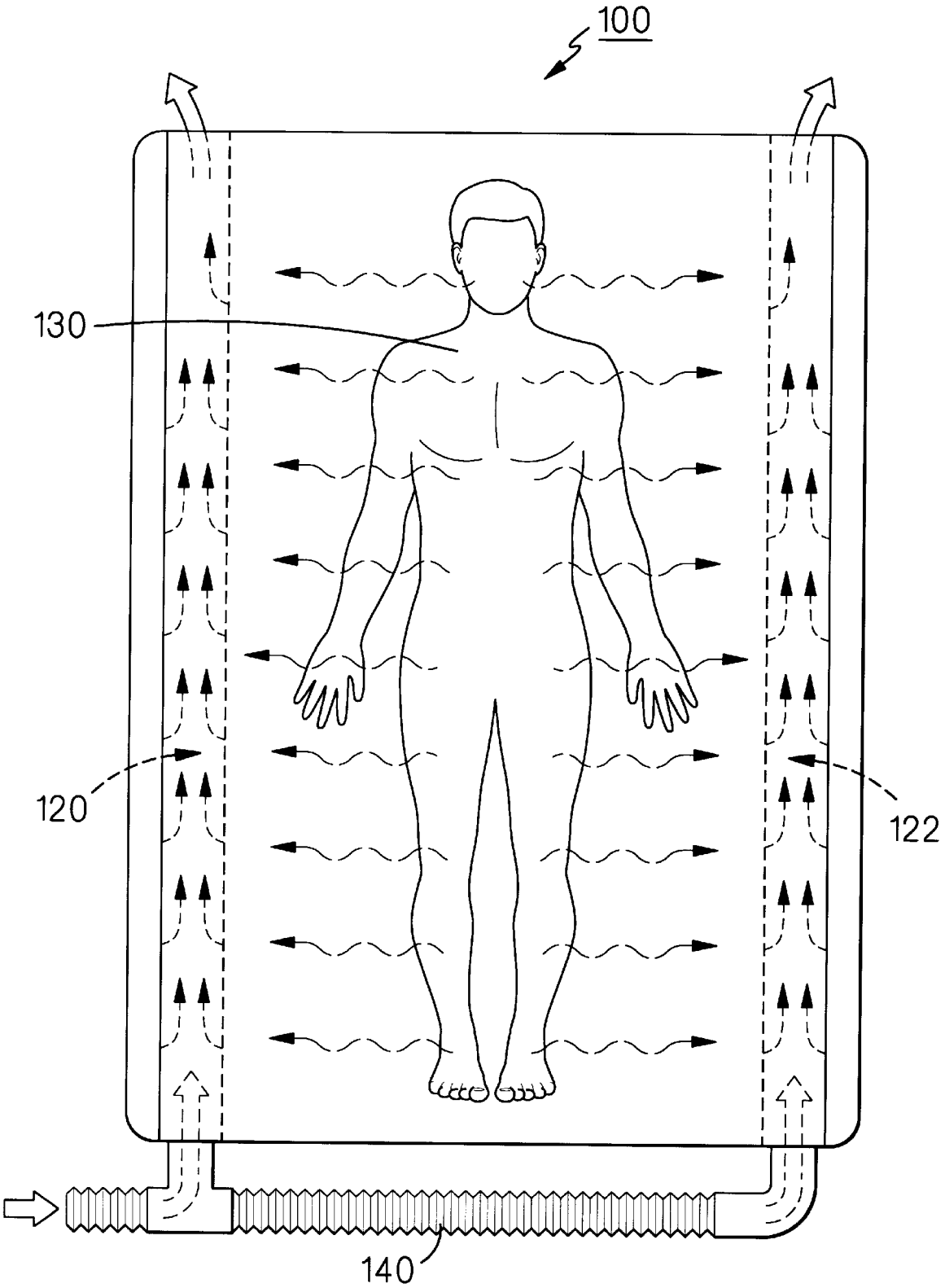
FIG. 5 is a top plan schematic view of the patient moisture control support surface coverlet of FIG. 4 in use.

FIG. 5 illustrates coverlet 100 disposed on a mattress or other support surface (not shown), with a patient 130 reposed on the coverlet. A pressurized air conduit 140 to one set of ends of channels 120 and 122, with the air exiting the other set of ends of the channels. With reference also to FIG. 4, moisture from patient 130 flows through upper layer 102 and then migrates through fabric layer 110, by capillary action to channels 120 and 122 where it evaporates into the dry air flow and is discharged from the open ends of the channels. It will be understood that suitable means may be provided to secure coverlet 100 on its supporting structure. A particular advantage of coverlet 100 is that only very low air pressure is required.

Having the edges of coverlet 100 releasably sealed affords easy access to fabric layer 110 for the cleaning of that layer and the internal surfaces of the coverlet.

While coverlets 20 and 100 have been described, for illustrative purposes, as being used with bed-type supporting structures, it will be understood that, suitably dimensioned, they are applicable as well to other types of supporting structures, such as chairs and wheelchair seats, for example, on which a patient may be reposed.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A patient moisture control support surface coverlet to draw moisture from a patient reposed thereon, said coverlet comprising:

(a) an upper layer of an air-tight, water-vapor-permeable material;

(b) a lower layer of an air- and vapor-impermeable material underlying said upper layer and sealed to a lower surface of said upper layer to define therebetween a volume to underlie a substantial portion of said patient;

(c) means to introduce a flow of air to at least a portion of said volume; and (d) means to permit said flow of air to exit said at least a portion of said volume.

2. A patient moisture control support surface coverlet, as defined in claim 1, wherein: said upper layer is constructed of 70-denier taffeta with a water-vapor-breathable polyurethane coating.

3. A patient moisture control support surface coverlet, as defined in claim 1, wherein: said lower layer is constructed of 8–24-ounce polyester batting.

4. A patient moisture control support surface coverlet, as defined in claim 1, wherein: said means to introduce pressurized air includes an air supply furnishing said flow of air at about 2–4 inches water pressure.

5. A patient moisture control support surface coverlet, as defined in claim 1, further comprising:

(a) said at least a portion of said volume comprises internal channels disposed at either edge of said coverlet and extending therealong; and (b) a moisture-wicking fabric layer disposed between said upper and lower layers to receive moisture passing through said upper layer and to pass said moisture to said air flow in said channels.

6. A patient moisture control support surface coverlet, as defined in claim 1, wherein: said flow of air flows generally throughout said volume.

7. A method of providing patient moisture control to draw moisture from a patient reposed thereon, said method comprising:

(a) providing an coverlet including an upper layer of an air-tight, water-vapor-permeable material and a lower layer of an air-and vapor-impermeable material underlying said upper layer and sealed to a lower surface of said upper layer to define therebetween a volume to underlie a substantial portion of said patient;

(b) placing said coverlet on a supporting structure;

(c) introducing a flow of air to at least a portion of said volume; and (d) permitting said flow of air to exit said volume.

8. A method, as defined in claim 7, further comprising: providing said upper layer constructed of 70-denier taffeta with a polyurethane coating.

9. A method, as defined in claim 7, further comprising: providing said lower layer constructed of 8–24-ounce polyester batting.

10. A method, as defined in claim 7, further comprising: introducing said flow of air at about 2–4 inches water pressure.

11. A method, as defined in claim 7, further comprising:

(a) providing said at least a portion of said volume comprising internal channels disposed at either edge of said coverlet and extending therealong; and (b) providing a moisture-wicking fabric layer disposed between said upper and lower layers to receive moisture passing through said upper layer and to pass said moisture to said air flow in said channels.

12. A method, as defined in claim 7, further comprising: providing said flow of air flowing generally throughout said volume.

13. A patient moisture control support surface coverlet to draw moisture from a patient reposed thereon, said coverlet comprising:

(a) an outer layer of an air-tight, water-vapor-permeable material;

(b) an inner layer of an air- and vapor-impermeable material underlying said outer layer and sealed to the lower surface of said outer layer to define therebetween a volume to underlie a substantial portion of said patient;

(c) means to introduce a flow of air to at least a portion of said volume;

(d) means to permit said flow of air to exit said at least a portion of said volume;

(e) said at least a portion of said volume comprising internal channels disposed at either edge of said coverlet and extending therealong; and (f) a moisture-wicking fabric layer disposed between said outer and inner layers to receive moisture passing through said outer layer and to pass said moisture to said air flow in said channels.

14. A patient moisture control support surface coverlet, as defined in claim 1, wherein: said outer layer is constructed of 70-denier taffeta with a water-vapor-breathable polyurethane coating.

15. A patient moisture control support surface coverlet, as defined in claim 13, wherein: said means to introduce pressurized air includes an air supply furnishing said flow of air at about 2–4 inches water pressure.

16. A method of providing patient moisture control to draw moisture from a patient reposed thereon, said method comprising:

(a) providing an coverlet including an outer layer of an air-tight, water-vapor-permeable material and an inner layer of an air- and vapor-impermeable material underlying said outer layer and sealed to the lower surface of said outer layer to define therebetween a volume to underlie a substantial portion of said patient;

(b) placing said coverlet on a supporting structure;

(c) introducing a flow of air to at least a portion of said volume;

(d) permitting said flow of air to exit said volume;

(e) providing said at least a portion of said volume comprising internal channels disposed at either edge of said coverlet and extending therealong; and (f) providing a moisture-wicking fabric layer disposed between said outer and inner layers to receive moisture passing through said outer layer and to pass said moisture to said air flow in said channels.

17. A method, as defined in claim 16, further comprising: providing said outer layer constructed of 70-denier taffeta with a polyurethane coating.

18. A method, as defined in claim 16, further comprising: introducing said flow of air at about 2–4 inches water pressure.

* * * * *